US010273427B2

(12) United States Patent
Vernon

(10) Patent No.: US 10,273,427 B2
(45) Date of Patent: Apr. 30, 2019

(54) FIRELIGHTER WITH PALM FATTY ACID DISTILLATE

(71) Applicant: Standard Brands (UK) Limited, Leatherhead, Surrey (GB)

(72) Inventor: Fredrick Michael Joseph Vernon, County Louth (IE)

(73) Assignee: STANDARD BRANDS (UK) LIMITED, Leatherhead (GB)

( * ) Notice: Subject to any disclaimer, the term of this patent is extended or adjusted under 35 U.S.C. 154(b) by 0 days.

(21) Appl. No.: 15/749,703

(22) PCT Filed: Aug. 8, 2016

(86) PCT No.: PCT/GB2016/052456
§ 371 (c)(1),
(2) Date: Feb. 1, 2018

(87) PCT Pub. No.: WO2017/025733
PCT Pub. Date: Feb. 16, 2017

(65) Prior Publication Data

US 2018/0223207 A1 Aug. 9, 2018

(30) Foreign Application Priority Data

Aug. 13, 2015 (GB) ..... 1514421.5

(51) Int. Cl.
*C10L 11/04* (2006.01)

(52) U.S. Cl.
CPC ..... *C10L 11/04* (2013.01); *C10L 2200/0469* (2013.01); *C10L 2230/06* (2013.01); *C10L 2290/22* (2013.01)

(58) Field of Classification Search
CPC ..... C10L 11/04; C10L 2200/0469; C10L 2290/22; C10L 2230/06
See application file for complete search history.

(56) References Cited

U.S. PATENT DOCUMENTS

| | | | | |
|---|---|---|---|---|
| 4,518,394 | A * | 5/1985 | Templin | C10L 11/04 44/544 |
| 2011/0016772 | A1 | 1/2011 | Talwar | |
| 2013/0040248 | A1* | 2/2013 | Perlman | F23K 1/00 431/2 |
| 2014/0366431 | A1* | 12/2014 | Lee | C10L 5/00 44/579 |

FOREIGN PATENT DOCUMENTS

| | | | | |
|---|---|---|---|---|
| EP | 2226378 | A1 * | 9/2010 | C10L 11/04 |
| GB | 2300646 | A | 11/1996 | |
| GB | 2389858 | A | 12/2003 | |
| WO | WO-03104362 | A1 * | 12/2003 | C10L 5/361 |
| WO | WO-2014051180 | A1 * | 4/2014 | C10L 5/00 |

OTHER PUBLICATIONS

Intellectual Property Office, Search Report issued in corresponding Application No. GB1514421.5, dated Feb. 8, 2016.

* cited by examiner

*Primary Examiner* — Pamela H Weiss
(74) *Attorney, Agent, or Firm* — Stites & Harbison, PLLC; Mandy Wilson Decker

(57) ABSTRACT

This invention relates to solid firelighters of the type which may be used to initiate combustion of i) barbecues (BBQs), irrespective of whether the barbecue fuel is in the form of charcoal lump wood or briquettes, ii) natural wood in outdoor wood fires or iii) any domestic or commercial fires. Firelighters of the present invention comprise: 25 to 75% by weight fiberboard having a density of from 0.1 to 0.5 g/cm$^3$; and 25 to 75% by weight palm fatty acid distillate; wherein the fiberboard is impregnated with the palm fatty acid distillate.

20 Claims, No Drawings

FIRELIGHTER WITH PALM FATTY ACID DISTILLATE

FIELD OF THE INVENTION

This invention relates to solid firelighters of the type which may be used to initiate combustion of i) barbecues (BBQs), irrespective of whether the barbecue fuel is in the form of charcoal lump wood or briquettes, ii) natural wood in outdoor or indoor wood fires or iii) any other domestic or commercial fires.

BACKGROUND TO THE INVENTION

Firelighters have traditionally included as the fuel a petroleum derivative, such as kerosene in white firelighters, and petroleum waxes in wood-based products. With an increasing awareness of environmental issues, there is a need to move away from petroleum derived products.

So-called 'natural' firelighters, in which the ingredients include naturally occurring materials not derived from fossil fuels, are known. However, the performance and shelf life of these firelighters to date has not been as good as desired, and they can be more expensive than petroleum based firelighters to produce.

The need remains, therefore, for a firelighter which is both natural and environmentally friendly, but which exhibits improved performance with excellent initial ignition and flame development, and has an improved shelf life.

SUMMARY OF THE INVENTION

According to a first aspect, the present invention relates to a firelighter comprising: 25 to 75% by weight fibreboard having a density of from 0.1 to 0.5 g/cm$^3$; and 25 to 75% by weight palm fatty acid distillate; wherein the fibreboard is impregnated with the palm fatty acid distillate.

According to a second aspect, the present invention relates to a method of making a firelighter, the method comprising the steps of: providing fibreboard having a density of from 0.1 to 0.5 g/cm$^3$; and impregnating the fibreboard with palm fatty acid distillate by either dipping the fibreboard into molten palm fatty acid distillate or spraying molten palm fatty acid distillate onto the fibreboard; wherein the firelighter comprises 25 to 75% by weight fibreboard and 25 to 75% by weight palm fatty acid distillate.

Palm fatty acid distillate, hereinafter referred to as PFAD, is a by-product from refining crude palm oil and is thus available at low cost, compared to many fuels traditionally included in firelighters. It is generally used in the soap industry, animal feed industry, and as a raw material for the oleochemical industries, for example in the manufacture of candles, cosmetics and toiletries.

The present inventors have discovered that PFAD can advantageously be incorporated into a fibreboard firelighter to provide an economical product that has excellent performance. PFAD is a semi solid at room temperature which means that, in contrast to possible other natural fuels which are liquid at room temperature, such as biodiesel, high levels of fuel can be incorporated, and leakage of fuel out of the fibreboard is reduced. With liquid fuels, the fuel can "fall out" of the fibreboard over time. This leads at best to staining and at worst to the risk of significant levels of free flammable liquid in the packaging. However, the PFAD still had a low melt point, flash point, and boiling range compared to petroleum waxes. Accordingly, the use of PFAD can lead to improved performance and a longer shelf life. Further benefits are that firelighters of the present invention are environmentally friendly and economical to produce.

DESCRIPTION

The present invention relates to firelighters comprising two main components, fibreboard, and PFAD.

Fibreboard is an engineered product that is made from wood or other plant fibres or particles and adhesive that is compressed into a board. The fibreboard makes up 25 to 75% by weight of the total firelighter. This reflects the fact that by using low density fibreboard in combination with PFAD, which is semi-solid at room temperature, high levels of fuel i.e. more than half of the weight of the firelighter, can be incorporated. In preferred embodiments, the firelighter comprises 30 to 50%, preferably 30 to 40% fibreboard, most preferably around 35% fibreboard.

The fibreboard of the present invention has a density of from 0.1 to 0.5 g/cm$^3$, which is a relatively low density. This is important to allow for a high level of fuel to be incorporated. In a preferred embodiment, the fibreboard has a density of 0.2 to 0.3 g/cm$^3$, preferably 0.2 to 0.25 g/cm$^3$ The firelighters of the present invention also include by weight based on the firelighter 25 to 75% palm fatty acid distillate. In a preferred embodiment, the firelighter comprises 50 to 70%, preferably 60 to 70% palm fatty acid distillate, most preferably around 65% palm fatty acid distillate.

Palm fatty acid distillate (PFAD) is a by-product from refining crude palm oil, and is well known to the skilled person. PFAD comprises mainly free fatty acids (usually more than 70 or even 80%) with palmitic acid and oleic acid being the major components. The remaining components are triglycerides, partial glycerides and unsaponifiable materials, such as vitamin E, sterols, squalenes, and volatile substances.

The properties of PFAD are well documented, such as in the article "Characteristics and Properties of Fatty Acid Distillates from Palm Oil" by Bonnie Tay Yen Ping and Mohtar Yusof, in *Oil Palm Bulletin* 59 (November 2009) p. 5-11. From this article the general characteristics of PFAD and composition of the main components is given below. Further details of the composition and properties of PFAD are given in this article, which is incorporated herein by reference.

TABLE 4

GENERAL CHARACTERISTICS OF PALM FATTY ACID DISTILLATE

| | Moh (1999) | | | Tay (2007) | | |
|---|---|---|---|---|---|---|
| Parameter | Range | Mean | SD | Range | Mean | SD |
| Iodine value,Wijs (g/100 g) | 50.3-62.7 | 55.1 | 1.93 | 46.3-57.6 | 54.8 | 1.95 |
| FFA (palmitic, %) | 74.6-93.9 | 86.9 | 3.58 | 72.7-92.6 | 86.4 | 2.52 |

TABLE 4-continued

GENERAL CHARACTERISTICS OF PALM FATTY ACID DISTILLATE

| Parameter | Moh (1999) Range | Moh (1999) Mean | Moh (1999) SD | Tay (2007) Range | Tay (2007) Mean | Tay (2007) SD |
|---|---|---|---|---|---|---|
| Conventional mass per volume at 50° C. (kg litre$^{-1}$) | 0.7170-0.8891 | 0.8699 | 0.0194 | 0.8640-0.8880 | 0.8725 | 0.0039 |
| Titre (° C.) | 45.0-47.8 | 46.3 | 0.55 | 46.0-48.3 | 46.7 | 0.58 |
| Water content (%) | 0.04-0.93 | 0.21 | 0.246 | 0.03-0.24 | 0.104 | 0.106 |
| Saponifiable value (mg KOH g$^{-1}$ of sample) | 196-222 | 205 | 5.4 | 200.3-215.4 | 209.5 | 5.0 |
| Unsaponifiable matter (%) | 0.9-4.5 | 1.6 | 0.58 | 1.0-2.5 | 1.61 | 0.43 |

Note:
SD—standand deviation.

TABLE 7

FATTY ACID COMPOSITION (FAC) OF PALM FATTY ACID DISTILLATE (PFAD) (weight % methyl ester)

| FAC | Range This study | Range Moh et al. (1999) | Mean This study | Mean Moh et al. (1999) | SD. This study | SD. Moh et al. (1999) |
|---|---|---|---|---|---|---|
| C8:0 capric | 0-0.3 | 0-0.2 | 0.2 | 0.1 | 0.08 | 0.05 |
| C10:0 caprylic | 0-0.2 | 0-0.2 | 0.17 | 0.1 | 0.06 | 0.04 |
| C12:0 lauric | 0.1-2.4 | 0.1-1.7 | 0.46 | 0.4 | 0.61 | 0.30 |
| C14:0 myristic | 0.9-1.6 | 1.0-1.8 | 1.20 | 1.2 | 0.20 | 0.19 |
| C16:0 palmitic | 43.0-49.1 | 46.4-51.2 | 46.9 | 47.8 | 1.46 | 1.40 |
| C16:1 palmitoleic | 0.1-0.3 | 0.2-0.3 | 0.15 | 0.2 | 0.06 | 0.01 |
| C18:0 stearic | 4.0-4.5 | 3.7-5.1 | 4.30 | 4.3 | 0.13 | 0.29 |
| C18:1 oleic | 34.7-37.2 | 33.0-37.7 | 36.7 | 36.2 | 1.13 | 1.41 |
| C18:2 linolenic | 8.5-9.7 | 7.8-9.6 | 9.03 | 8.9 | 0.28 | 0.45 |
| C18:3 | 0.3-0.5 | 0.3-0.5 | 0.31 | 0.4 | 0.096 | 0.07 |
| C20:0 arachidic | 0.0-0.4 | 0.3-0.4 | 0.28 | 0.3 | 0.08 | 0.05 |
| Others | 0-0.2 | 0-0.5 | 0.10 | 0.3 | 0.05 | 0.12 |

In some embodiment, the firelighter additionally comprises an ignition promoter. The ignition promoter is typically present at a level of 0.1 to 10%, preferably 0.5 to 5%, most preferably 1 to 2% by weight of the firelighter.

The flash point of the ignition promoter is usually below 150° C. and preferably below about 100° C., more preferably below about 80° C. The material may be selected from isoprenoid compounds and oxygenated isoprenoid compounds, including terpenes such as terpinolene [f.pt: 53° C.], terpineol [f.pt: 78° C.], eugenol [f.pt: 110° C.], linalool [f.pt: 76° C.], limonene [f.pt: 46° C.], cineol [f.pt: 49° C.], turpentine [f.pt: 27° C.], generally a mixture of α-pinene and β-pinene; other natural-derived materials such as vegetable oils, for example tall oil [f.pt: 150° C.], and derivatives such as tall oil pitch [f.pt: 150° C.], and methyl to hexyl esters of long-chain fatty acids, particularly those narrow cuts chosen from $C_8$-$C_{10}$ carboxylic acid methyl ester [f.pt: 64° C.] and $C_{10}$-$C_{12}$ carboxylic acid methyl ester [f.pt: 74° C.], as well as broad cut methyl or other lower alkyl esters of the type commercially available as 'biodiesels' [f.pt: 125° C.], generally esters of lipids, especially of triglycerides. The ignition promoter is preferably methyl decanoate.

The fibreboard is impregnated with the palm fatty acid distillate. One method of making the firelighter comprises the steps of: providing fibreboard having a density of from 0.1 to 0.5 g/cm$^3$; and impregnating the fibreboard with palm fatty acid distillate by either dipping the fibreboard into molten palm fatty acid distillate or spraying molten palm fatty acid distillate onto the fibreboard; wherein the firelighter comprises 25 to 75% by weight fibreboard and 25 to 75% by weight palm fatty acid distillate.

The firelighter of the present invention is used in the same way as a conventional firelighter, by placing the firelighter in a BBQ, stove, or any other domestic or commercial fire, placing the main fuel around and on top of the firelighter, and lighting the firelighter. Heat and flames from the firelighter initiate combustion of the main fuel.

Firelighters of the present invention light easily, stay lit for a long time, and generate more useful heat than many prior art firelighters, especially prior art firelighters derived from natural sources. This is thought to be due to use of PFAD which, despite not being known for this purpose, has good combustion properties in combination with low density fibreboard. Due to its semi-solid state at room temperature, PFAD can be incorporated at high levels into fibreboard, which leads to the advantageous properties of the present invention. However, as it still has a relatively low melting point compared to waxes, not much energy is needed to convert it to a molten state for impregnation into the fibreboard. As PFAD is a by-product, the present invention also has the advantage of enabling the firelighters to be produced economically, while providing a way of recycling the PFAD.

Example

Experiments were undertaken to test firelighters according to the present invention compared to prior art firelighters that are currently on the market. The firelighter according to the present invention was made with PFAD on low density fibreboard, as defined in the present invention. Each of the prior art "competitor products" used a petroleum based wax on fibreboard.

TABLE 1

| PARAMETER | Firelighter according to the invention | Typical Results for Competitor Products 1 | Typical Results for Competitor Products 2 |
|---|---|---|---|
| Product Type | Individual Natural Cubes. | Individual Wood/Wax cubes. | Individual Wood/Wax cubes. |
| Fuel Type | Palm Fatty Acid Distillate on fibreboard | Petroleum based wax on fibreboard. | Petroleum based wax on fibreboard. |
| Avg. Wt. per Piece | 21.2 gm. | 6.0 gm. | 12.1 gm |
| Piece Dimensions | 27 x 27 x 35 mm. | 27 x 20 x 18 mm. | 30 x 30 x 30 mm. |
| Cube Volume | 25.5 $cm^3$. | 9.7 $cm^3$. | 27 $cm^3$. |
| Ignition | 1 second, very good uptake. | 1 touch, slow uptake. | 1 touch, slow uptake. |
| Flame spread | 7 seconds. | 70 seconds. | 60 seconds. |
| Burn Time | 13.6 minutes. | 8.4 minutes. | 11.0 minutes. |
| Burn Rate | 38.5 seconds/gm. | 84.0 seconds/gm. | 54.5 seconds/gm. |
| Flame Height | Excellent. | Poor. | Poor. |
| Specification Burn Time | 13 ± 1 minutes. | Typically 8 ± 1 minutes. | Typically 10 ± 1 minutes. |

As can be seen in Table 1, the firelighter according to the present invention exhibited very significantly better performance than the prior art firelighters.

The invention claimed is:

1. A firelighter comprising:

25 to 75% by weight fibreboard having a density of from 0.1 to 0.5 g/$cm^3$; and 25 to 75% by weight palm fatty acid distillate; wherein the fibreboard is impregnated with the palm fatty acid distillate.

2. The firelighter according to claim 1, wherein the firelighter additionally comprises an ignition promoter.

3. The firelighter according to claim 2, wherein the ignition promoter is methyl decanoate.

4. The firelighter according to claim 2, wherein the ignition promoter is present at a level of 1 to 2% by weight of the firelighter.

5. The firelighter according to claim 1, wherein the firelighter comprises 30 to 40% fibreboard.

6. The firelighter according to claim 1, wherein the fibreboard has a density of 0.2 to 0.3 g/$cm^3$.

7. The firelighter according to claim 1, wherein the firelighter comprises 60 to 70% palm fatty acid distillate.

8. A method of making a firelighter, the method comprising the steps of:

providing fibreboard having a density of from 0.1 to 0.5 g/$cm^3$; and impregnating the fibreboard with palm fatty acid distillate by either dipping the fibreboard into molten palm fatty acid distillate or spraying molten palm fatty acid distillate onto the fibreboard; wherein the firelighter comprises 25 to 75% by weight fibreboard and 25 to 75% by weight palm fatty acid distillate.

9. The firelighter according to claim 3, wherein the ignition promoter is present at a level of 1 to 2% by weight of the firelighter.

10. The firelighter according to claim 2, wherein the firelighter comprises 30 to 40% fibreboard.

11. The firelighter according to claim 3, wherein the firelighter comprises 30 to 40% fibreboard.

12. The firelighter according to claim 4, wherein the firelighter comprises 30 to 40% fibreboard.

13. The firelighter according to claim 1, wherein the firelighter comprises around 35% fibreboard.

14. The firelighter according to claim 2, wherein the fibreboard has a density of 0.2 to 0.3 g/$cm^3$.

15. The firelighter according to claim 3, wherein the fibreboard has a density of 0.2 to 0.3 g/$cm^3$.

16. The firelighter according to claim 4, wherein the fibreboard has a density of 0.2 to 0.3 g/$cm^3$.

17. The firelighter according to claim 1, wherein the fibreboard has a density of 0.2 to 0.25 g/$cm^3$.

18. The firelighter according to claim 2, wherein the firelighter comprises 60 to 70% palm fatty acid distillate.

19. The firelighter according to claim 3, wherein the firelighter comprises 60 to 70% palm fatty acid distillate.

20. The firelighter according to claim 1, wherein the firelighter comprises around 65% palm fatty acid distillate.

* * * * *